United States Patent [19]

Probyn et al.

[11] 4,292,034

[45] Sep. 29, 1981

[54] PARTITION FOLDING AND INSERTING MACHINE

[75] Inventors: Keith A. Probyn; Richard W. Nolen; Charles W. Erickson; Gerald G. Dawson, all of Mapleton; Ralph Goldstein; Max Bender, both of Carol Stream, all of Ill.

[73] Assignee: Northern Petrochemical Co., Omaha, Nebr.

[21] Appl. No.: 98,236

[22] Filed: Nov. 28, 1979 (Under 37 CFR 1.47)

[51] Int. Cl.[3] ..... B31B 11/26

[52] U.S. Cl. ..... 493/92; 493/125; 493/312

[58] Field of Search ..... 93/37 SP, 37 R, 37 EC, 93/38; 229/28 R; 493/90–92, 312, 912, 125, 126, 121–123

[56] References Cited

U.S. PATENT DOCUMENTS

| | | | |
|---|---|---|---|
| 2,811,087 | 10/1957 | Nigrelli | 93/37 SP X |
| 3,473,295 | 10/1969 | Nigrelli et al. | 93/37 SP X |
| 3,605,572 | 9/1971 | Derderian | 493/92 X |
| 3,780,627 | 12/1973 | Roda | 493/92 X |
| 3,803,993 | 4/1974 | Graham | 493/90 |
| 3,965,804 | 6/1976 | Elford | 493/168 X |
| 3,978,773 | 9/1976 | Pinto | 493/93 |
| 4,111,105 | 9/1978 | Culpepper et al. | 493/92 |
| 4,154,148 | 5/1979 | Weremiczyk et al. | 493/90 |
| 4,171,081 | 10/1979 | Vossen et al. | 93/36 A X |

*Primary Examiner*—James F. Coan

*Attorney, Agent, or Firm*—Zarley, McKee, Thomte, Voorhees & Sease

[57] ABSTRACT

A partition folding and inserting machine is described which automatically folds a flat partition blank into a partition and then inserts the partition into a box which is moving on a conveyor. A hydraulic lift table is provided at the feed end of the machine for supplying a stack of flat partition blanks to the intake or feed end of a first conveyor. An individual partition blank is lifted from the stack of partition blanks and is moved into the machine by the first conveyor. A tab breaker apparatus initially breaks or severs a portion of the partition blank to facilitate the subsequent folding of the partition blank. A cell opening apparatus engages the upper and lower sides of the partition blank to move the same downwardly to partially form cells at the outer sides of the partition blank. The partially folded partition blank is then moved by means of a second conveyor through a side plow or guide which further deforms the partition blank. An inserter apparatus further folds the partition blank and inserts the same downwardly into a box moving on a conveyor. The partition, when inserted into the box, permits the box to accommodate six containers.

10 Claims, 21 Drawing Figures

PARTITION FOLDING AND INSERTING MACHINE

BACKGROUND OF THE INVENTION

Partitions have long been inserted into boxes to enable the boxes to accommodate individual containers or the like. Heretofore, most of the box partitions were manually inserted into the boxes inasmuch as a reliable partition inserting machine was not available.

Therefore, it is a principal object of the invention to provide a partition folding and inserting machine.

A still further object of the invention is to provide a partition folding machine which folds a partition blank upon itself to create six cells.

A still further object of the invention is to provide a partition folding and inserting machine which folds a flat partition blank into a configuration such that when inserted into a box will accommodate six containers.

A still further object of the invention is to provide an automatic partition folding and inserting machine.

A still further object of the invention is to provide a partition folding and inserting machine which is reliable.

These and other objects will be apparent to those skilled in the art.

SUMMARY OF THE INVENTION

A partition folding and inserting machine is disclosed wherein a flat partition blank is folded by the machine to create a six cell partition for insertion into a box. The machine picks up an individual blank at the feed end of the machine and moves the same through the machine which folds the blank upon itself and inserts the same into a case at the discharge end of the machine. The partition when inserted into the box will accommodate six containers.

DESCRIPTION OF THE PREFERRED EMBODIMENT

Figure 1:
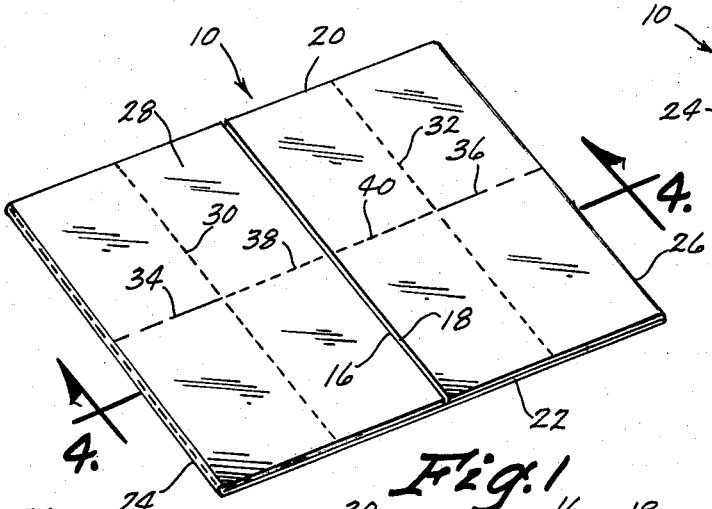
FIG. 1 is a perspective view of the flat partition blank prior to the partition blank being initially folded.
Figure 2:
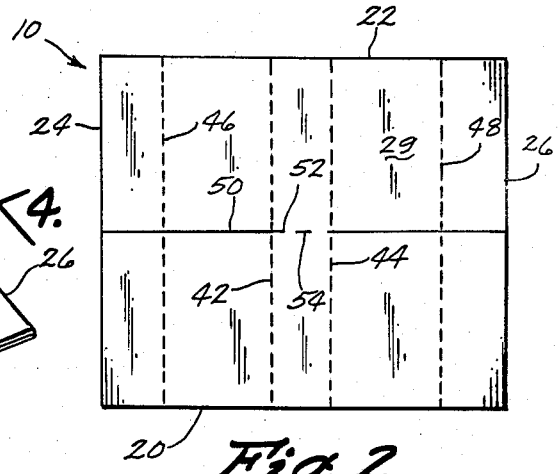
FIG. 2 is a bottom view of the partition blank of FIG. 1.

Referring to the drawings, the numeral 10 refers to the partition blank utilized in this invention which is subsequently folded by the machine 12 and inserted into a box 14 to form the partitions in the box to permit the box to accommodate six containers. Referring specifically to FIGS. 1 and 2, it can be seen that the partition blank 10 is formed from a single piece of cardboard or other paper material which is folded upon itself so that its ends 16 and 18 are slightly spaced from each other. For purposes of description, the partition blank 10, when folded to the position of FIG. 1, will be described as including a forward end 20, rearward end 22, opposite side edges 24 and 26, top portion 28 and bottom portion 29. The top and bottom portions are glued together at both sides of the ends 16 and 18.

The opposite side edges 24 and 26 are scored as illustrated in the drawings to permit subsequent folding therealong as will be described in more detail hereinafter. Top portion 28 is provided with score lines 30 and 32 spaced inwardly from side edges 24 and 26 which extend longitudinally with respect to the direction of travel of the blank through the machine. Top portion 28 is cut or sliced at 34 which extends inwardly from side edge 24 to score line 30. Likewise, top portion 28 is cut or scored at 36 which extends inwardly from side edge 26 to score line 32. Preferably, top portion 28 is not completely cut at 34 and 36 but is cut for approximately 98 percent of the lengths thereof so that the blank will maintain its shape during shipment and handling. Top portion 28 is also scored at 38 and 40. Score lines 38 and 40 extend outwardly from ends 16 and 18 respectively towards score lines 30 and 32 respectively. The outer ends of score lines 38 and 40 terminate inwardly of the score lines 30 and 32.

Figure 4:
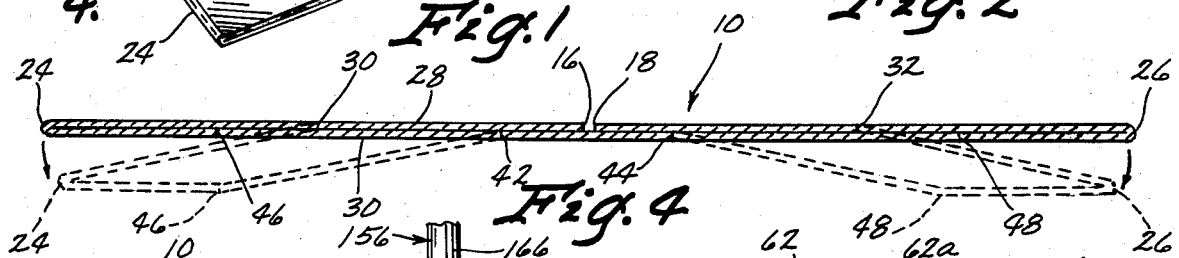
FIG. 4 is a sectional view seen on lines 4—4 of FIG. 1 illustrating the initial folding of the partition blank.
Figure 5:
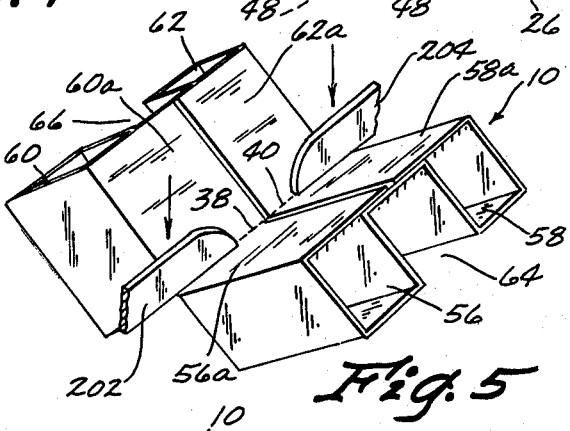
FIG. 5 is a perspective view illustrating the blank being folded and inserted by a partition tucker apparatus.
Figure 6:
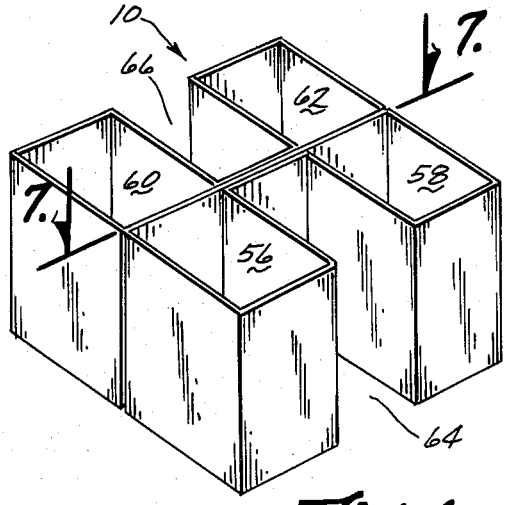
FIG. 6 is a perspective view of the partition in its folded form.
Figure 7:
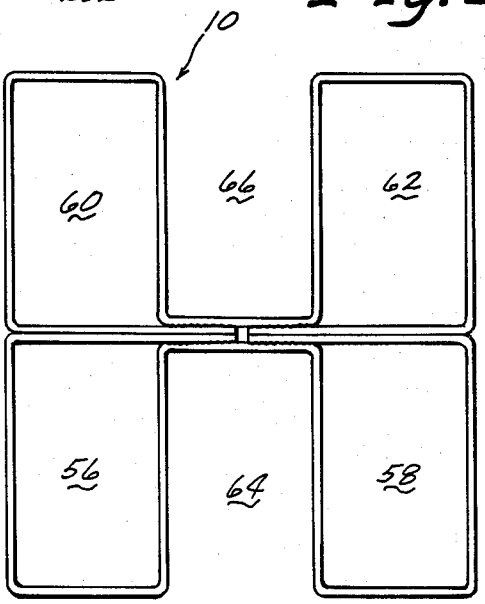
FIG. 7 is a top view of the folded partition as seen on lines 7—7 of FIG. 6.

Bottom portion 29 is provided with score lines 42 and 44 which extend longitudinally between the forward end 22 and the rearward end 20 of the blank as illustrated in FIG. 2. Bottom portion 30 is also provided with score lines 46 and 48 which are spaced outwardly from score lines 42 and 44 and which are parallel thereto. Bottom portion 29 is transversely cut along line 50 which extends between the side edges 24 and 26. Preferably, the cut line 50 is interrupted for approximately one-quarter inch at two locations identified as 52 and 54 to aid in maintaining the blank in its flat position during transportation, storage and initial folding. The blank 10 is folded by the machine 12 from the position of FIG. 1 to the position of FIG. 6 as follows. Downward vertical force is applied to the score lines 34 and 36 to separate the forward end of the blank from the rearward end of the blank inwardly from edges 24 and 26 to score lines 30 and 32 respectively. Downward vertical force is then applied to the blank inwardly of the side edges 24 and 26 while the center portion of the blank is maintained in position so that the blank is initially moved from the position illustrated by solid lines in FIG. 4 to the position illustrated by broken lines in FIG. 4. As seen in FIG. 4, the sides of top portion 28 are folded downwardly along score lines 30 and 32. Bottom portion 29 folds along score lines 46 and 48 as well as score lines 42 and 44. The folding of the blank to the position illustrated by broken lines in FIG. 4 creates cells 56, 58, 60 and 62 which define a parallelogram cross-section. The blank is further folded until the cells 56, 58, 60 and 62 are rectangular in section as seen in FIG. 5. In other words, the broken lines in FIG. 4 illustrate the cells being partially formed and it should be understood that the cells would be further deformed from the position of FIG. 4 until they defined a rectangular shape. Once the cells 56, 58, 60 and 62 have been deformed to a rectangular shape, downward vertical force is applied, as illustrated in FIG. 5, along the score lines 38 and 40 so that the blank is folded upon itself whereby the wall 56*a* of cell 56 is positioned adjacent the wall 60*a* of cell 60 and so that wall 58*a* of cell 58 is positioned adjacent wall 62*a*. FIGS. 6 and 7 illustrate the blank in its completely folded position prior to the blank being inserted into a box so that areas or cells for six containers are created. As seen in FIG. 7, cells 56 and 58 define a cell 64 therebetween while cells 60 and 62 define a cell 66 therebetween. When the blank of FIG. 7 is inserted into a box, containers are inserted into the cells 56, 58, 60, 62, 64 and 66. The machine 12 for folding the blank from the position of FIG. 1 to the position of FIG. 6 and the apparatus for inserting the folded blank into a box will now be described.

Figure 8:
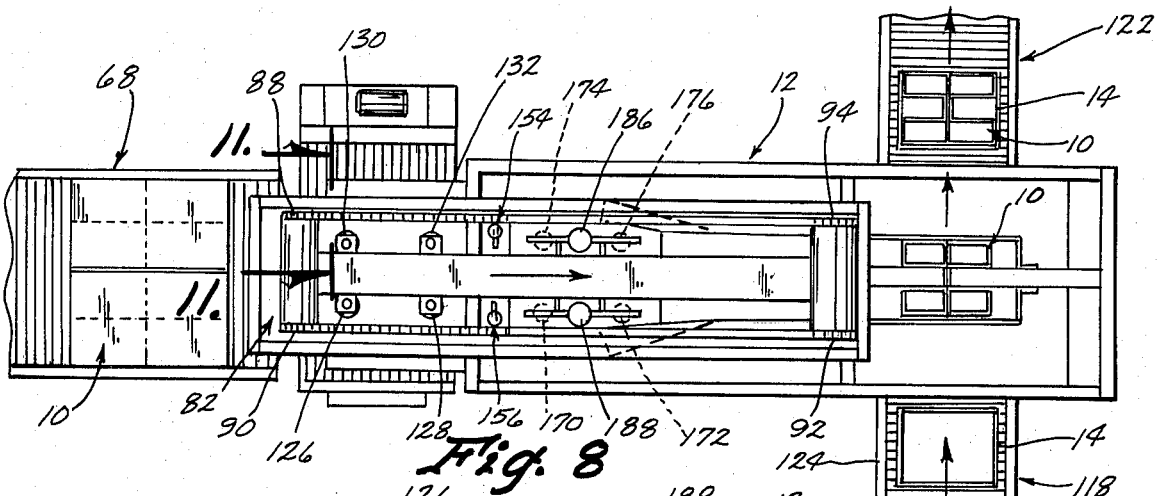
FIG. 8 is a top view of the machine.
Figure 9:
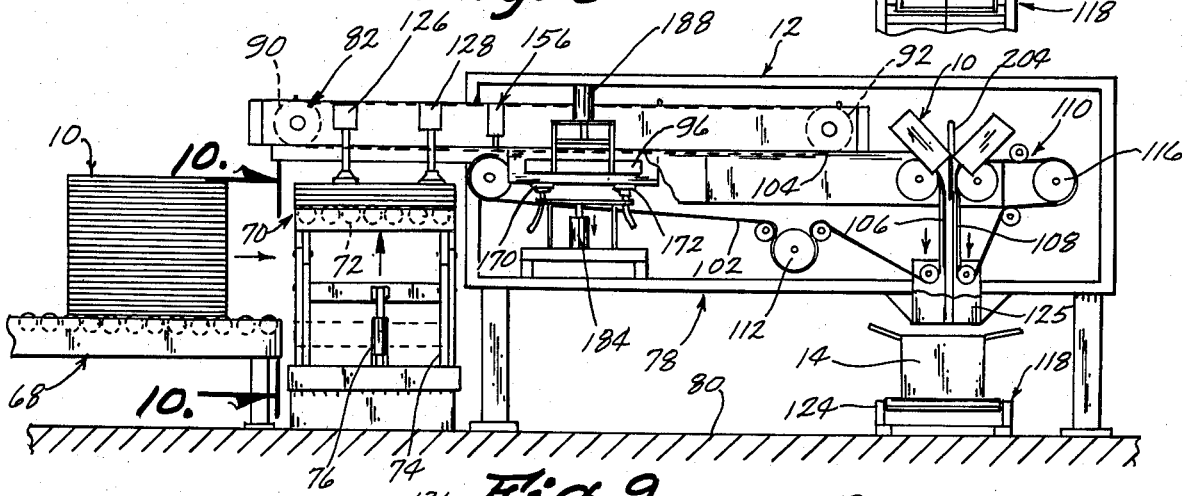
FIG. 9 is a side view of the machine.
Figure 10:
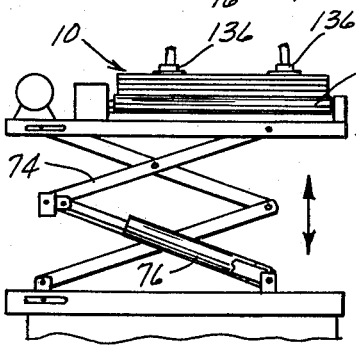
FIG. 10 is a view seen on lines 10—10 of FIG. 9 illustrating the lift table.

Referring to FIGS. 8 and 9, the numeral 68 refers to an optional conveyor for supplying a plurality of stacked partition blanks 10 to the machine 12. The conveyor 68 is not necessary for the operation of the machine but is a convenience item. Provided at the front or intake end of the machine 12 is a vertically movable lift table 70 having a plurality of powered conveyor rollers 72 mounted thereon adapted to support the blank 10. The table 70 is vertically movable by means of the scissor-type support 74 and power cylinder 76. Thus, the table 70 is lowered to facilitate the placement of a stack of blanks 10 thereon and is raised upwardly to facilitate the feeding of the individual blanks into the feed end of the machine 12.

Machine 12 generally comprises a frame means 78 which is supported on the supporting surface 80. The numeral 82 refers to an upper feed conveyor comprising a pair of spaced-apart chain members 84 and 86 which extend around a pair of sprockets 88 and 90 rotatably mounted on the frame means at the upper end thereof adjacent the feed end as illustrated in the drawings. Chains 84 and 86 also extend around a pair of sprockets 92 and 94 rotatably mounted on the frame means inwardly of the sprockets 88 and 90. Chains 84 and 86 are provided with a plurality of spaced-apart dogs 96 and 98 respectively which extend downwardly therefrom so as to engage end 22 of the partition blank so that the partition blank will be conveyed or fed into the machine upon rotation of the chains 84 and 86 by a suitable electric motor 100 connected thereto.

The numeral 102 refers to a lower feed belt conveyor having an upper flight portion 104 which is closely positioned beneath conveyor 82 for a portion of the length thereof as best seen in FIG. 9. Conveyor 102 also includes a flight portion 106 at its rearward end which is adjacent a belt portion 108 of a conveyor 110. Conveyor 102 is driven by drive pulley 112 operatively connected to an electric motor 114 which is also connected to the drive pulley 116 to drive the conveyor 110.

The numeral 118 refers to a box or case conveyor which supplies the empty boxes 14 into position adjacent the discharge end of the machine below the flight portions 106 and 108 of the conveyors 102 and 110 as will be described in more detail hereinafter. A box conveyor 122 extends from the machine for conveying the boxes 14 therefrom after the partition has been inserted into the individual box. A vertically movable box or case elevator 124 is provided beneath the machine between the conveyors 118 and 122 to vertically move the box 14 upwardly into position for engagement with the box guide 125 to facilitate the proper insertion of the partition into the box 14.

Figure 11:
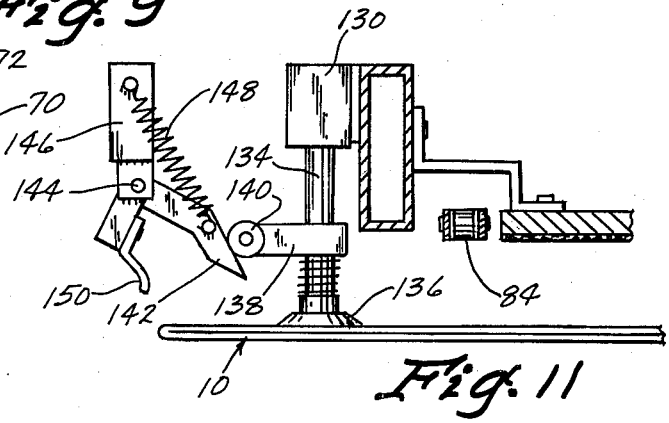
FIG. 11 is an enlarged sectional view seen on lines 11—11 of FIG. 8.
Figure 12:
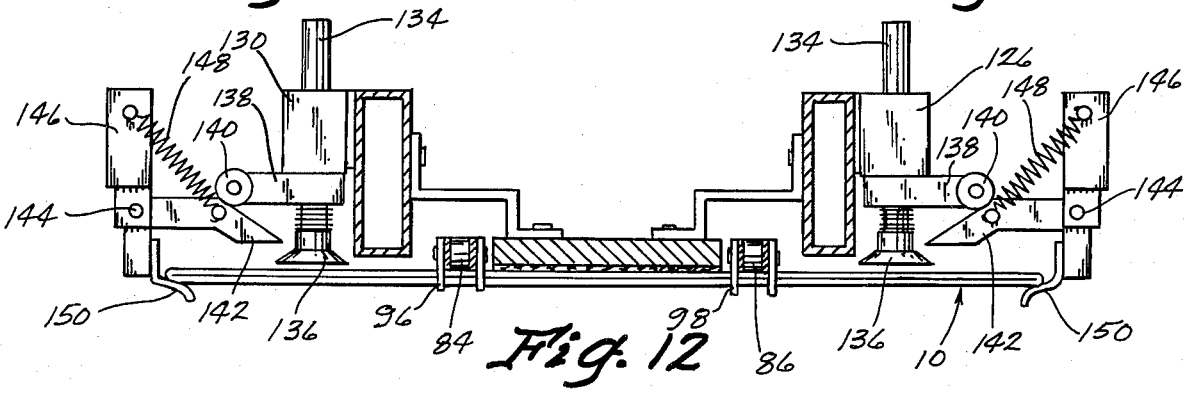
FIG. 12 is a view similar to FIG. 11 except that both sides of the vacuum pickup are illustrated and with the partition blank being in its raised position.
Figure 13:
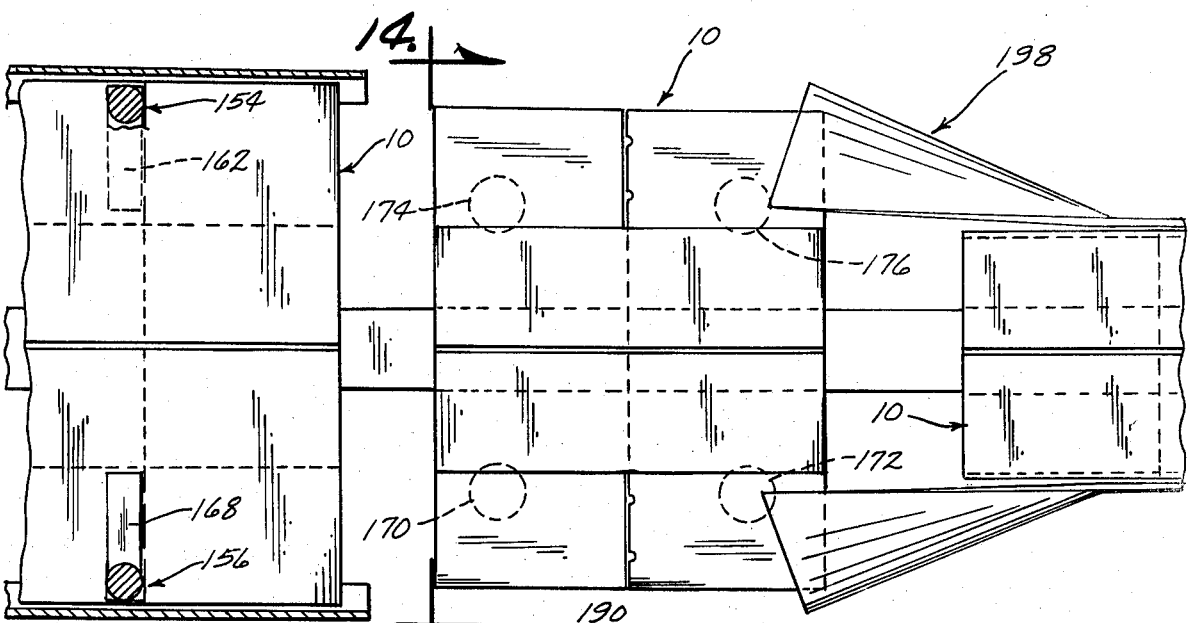
FIG. 13 is a partial top view of the machine.

Four vertically movable vacuum pick-up assemblies 126, 128, 130 and 132 are vertically movably mounted on the frame means 18 above the lift table for vacuum engagement with the partition blank as seen in FIGS. 11 and 12. The vacuum pick-up assembly 130 includes a vertically movable rod 134, the upper end of which is in communication with a source of vacuum. Pick-up head 136 is mounted on the lower end of the rod 134. Arm 138 is mounted on the rod 134 and extends laterally therefrom. As seen in FIG. 11, roller 140 is mounted on the outer end of arm 138 and is adapted to engage the follower arm 142. Follower arm 142 is pivotally connected at 144 to a support 146. Spring 148 yieldably urges the follower arm 142 to the position of FIG. 12. Guide 150 is mounted on the follower arm 142 for movement therewith and is adapted to support the side edge of the partition blank 10 when in the position of FIG. 12. All of the pick-up assemblies 126, 128, 130 and 132 are interconnected by a suitable support and are vertically movable as a unit by an air cylinder 152. Inasmuch as all the pick-up assemblies 126, 128, 130 and 132 are identical, only pick-up assembly 130 will be described in detail.

Figure 3:
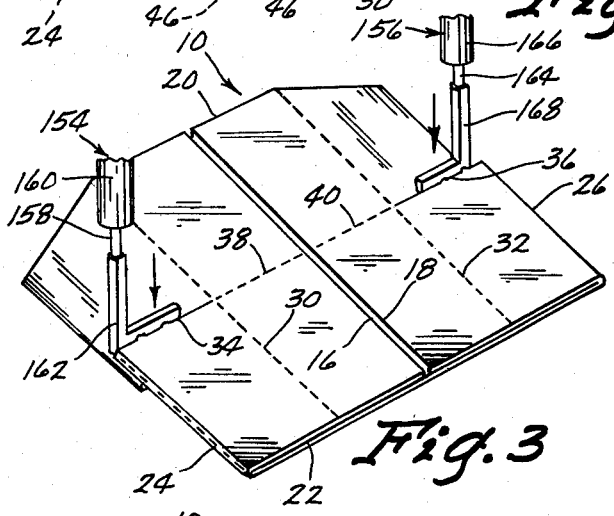
FIG. 3 is a front perspective view of the partition blank and the tab breakers which break the tabs at each side of the partition blank.

A pair of tab breakers 154 and 156 are mounted on the machine 12 inwardly of the pick-up assemblies as seen in FIG. 8. Tab breaker 154 comprises an air cylinder having rod 158 vertically movable extending from cylinder body 160. L-shaped member 162 is provided at the lower end of the rod 158. Likewise, tab breaker 156 comprises rod 164, cylinder body 166 and L-shaped member 168. The extension of the rods 158 and 164 from the cylinder bodies 160 and 166 causes the L-shaped members 162 and 168 to engage the partition blank 10 as indicated in FIG. 3 along the score lines 34 and 36 respectively so that the top portion 28 of the partition blank 10 is separated at the score lines 34 and 36.

Four vacuum cell opening assemblies 170, 172, 174 and 176 are mounted on the frame means inwardly of tab breakers 154 and 156. Each of the cell opening assemblies 170, 172, 174 and 176 comprises a vertically movable plunger 180 having a vacuum cup 182 at the upper end thereof which is adapted to engage the underside of the partition blank and to pull the same downwardly so that the partition blank is moved from the flat position illustrated by solid lines in FIG. 4 to the position of FIG. 14. Each of the vacuum cups 182 is in communication with a source of vacuum and are movably moved in unison by an air cylinder 184. A pair of cell opening back-up assemblies 186 and 188 are mounted on the frame means above the cell opening assemblies just described. Each of the cell opening back-up assemblies 186 and 188 comprises an air cylinder 190 having cylinder rod 192 extending therefrom. Rod 192 is operatively connected to an arm 194 which is pivotally secured thereto so that extension of the rod 192 from the air cylinder 190 causes the arm 194 to pivotally move downwardly to urge the partition blank from its flat position to the deformed position of FIG. 14. A longitudinally extending bar 196 is secured to the lower end of the arm 194 so that a substantial portion of the blank is engaged. The cell opening assemblies and the cell opening back-up assemblies cooperate to form the cells in the partition blank. Preferably, the cell opening assemblies 170, 172, 174 and 176 operate a fraction of a second prior to the operation of the cell opening back-up assemblies 186 and 188 to enhance the folding operation.

Figure 14:
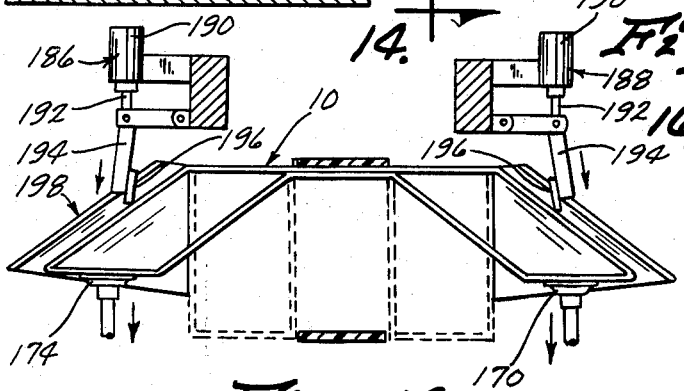
FIG. 14 is a sectional view seen on lines 14—14 of FIG. 13.
Figure 15:
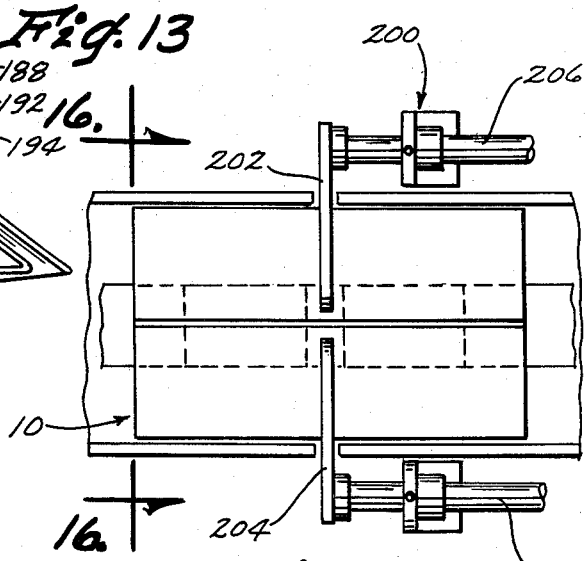
FIG. 15 is a partial top view of the machine illustrating the tucker arms and their relationship to the partition blank.

The numeral 198 refers to a side plow or guide assembly mounted on the frame means 78 so as to be positioned above and around the partition blank as it passes from the cell opening assemblies so that the partition blank is further folded from the solid line position of FIG. 14 to the position illustrated by broken lines in FIG. 14.

Figure 16:
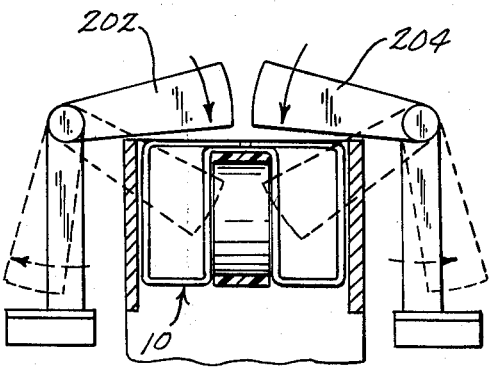
FIG. 16 is a sectional view as seen on lines 16—16 of FIG. 15.
Figure 17:
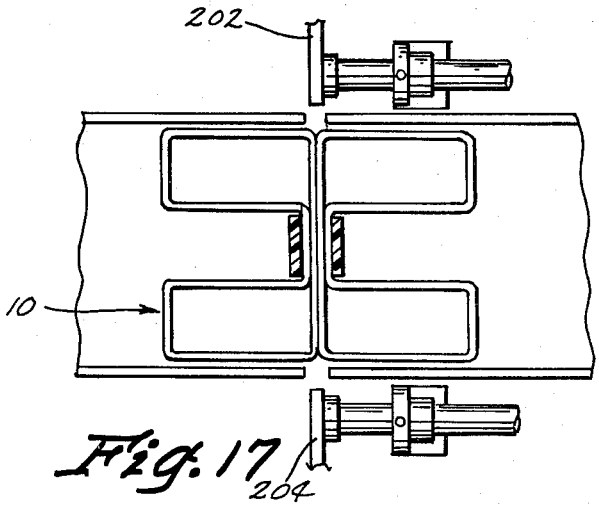
FIG. 17 is a view similar to FIG. 15 except that the partition has been moved downwardly from the position of FIG. 15.

The numeral 200 refers to a partition tucker comprising a pair of tucker arms 202 and 204 which are mounted on shafts 206 and 208 respectively. Shafts 206 and 208 are operatively connected to a drive motor so that the tucker arms 202 and 204 will engage the upper portion of the partition blank as illustrated in FIGS. 5 and 16 to deform the blank from the position of FIG. 16 to the position of FIG. 6. The tucker arms 202 and 204 not only deform the blank to the shape just described but also force the partition blank downwardly between the conveyor belt portions 106 and 108 for insertion into the box 14 as previously described.

Figure 18:
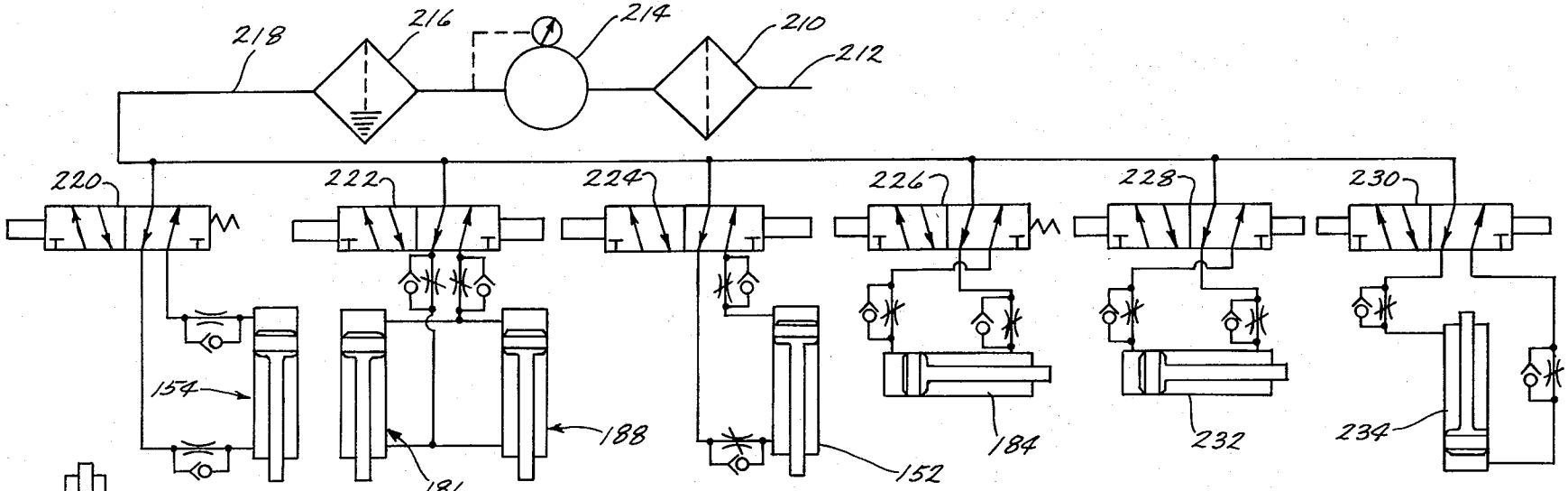
FIG. 18 is a schematic of the pneumatic circuitry of the machine.

FIG. 18 is a schematic of the pneumatic circuitry of this invention. Filter 210 is connected to a source of air pressure by line 212. Filter 210 is connected to the regulator 214 and the lubricator 216 as illustrated. Line 218 extends from lubricator 216 and is connected to the valves 220, 22, 224, 226, 228 and 230. Valve 220 is connected to the tab breaker cylinders which are connected in parallel. FIG. 18 illustrates only a single air cylinder for the tab breakers but it should be understood that a pair of air cylinders are employed. Valve 222 is connected to the cell opening back-up cylinders 186 and 188 while valve 224 is connected to the air cylinder 152 which is the blank feed cylinder controlling the operation of the pick-up assemblies 126, 128, 130 and 132. Valve 226 is connected to the cell opening cylinder 184 while valve 228 is connected to the shifter cylinder 232. Valve 230 is connected to air cylinder 234 which elevates the conveyor portion 124 upwardly from the position of FIG. 9.

Figure 20:
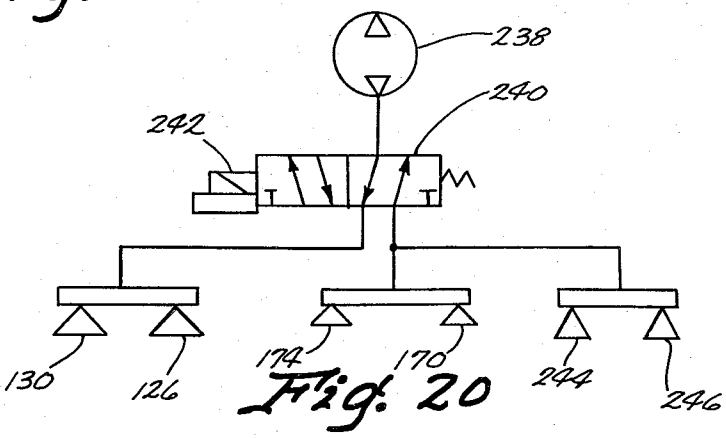
FIG. 20 is a schematic of the vacuum circuitry of the machine.
Figure 19:
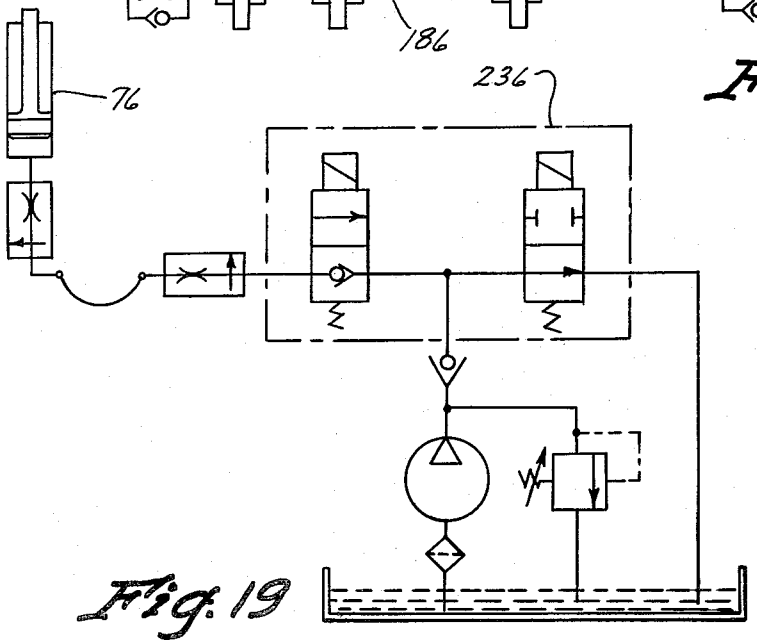
FIG. 19 is a schematic of the pneumatic and hydraulic circuitry of the lift table portion of the machine.

FIG. 19 illustrates the hydraulic circuitry for the lift table and it can be seen that the cylinder 76 is connected to an air pilot valve 236 to coordinate the operation of the lift table with the machine 12. In FIG. 20, vacuum pump 238 is connected to valve 240 which is operated by means of the air pilot 242. Valve 240 is connected to the blank feed vacuum pick-up assemblies generally indicated by the reference numerals 126 and 130 in FIG. 20. Valve 240 is also connected to the cell opening assemblies generally depicted by the reference numerals 170 and 174 in FIG. 20. Valve 240 is also connected to the cell opening assemblies 244 and 246.

Figure 21:
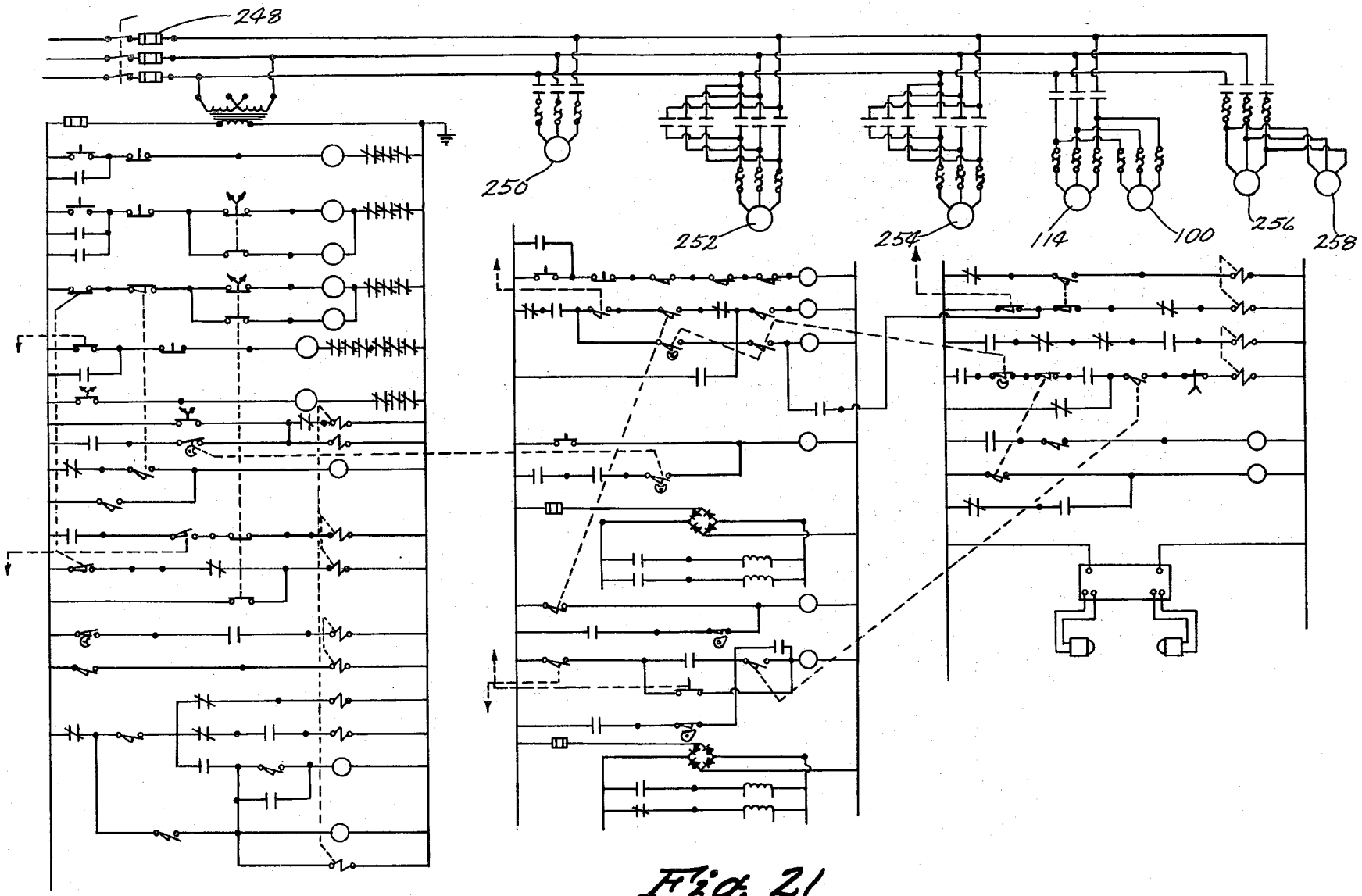
FIG. 21 is a schematic of the electrical circuitry of the invention.

FIG. 21 depicts the electrical circuitry of the invention and will not be described in detail other than to identify certain of the components thereof. The numeral 248 refers to a source of 460 volt, three phase, 60 HZ power. Lift table pump motor 250, main drive motor 252, pusher conveyor drive motor 254, box belt conveyor motor 114, box flight chain conveyor motor 110, blank feed vacuum pump motor 256 and elevator vacuum pump motor 258 are connected to the source of power.

The operation of the machine is as follows. A stack of the partition blanks 10 is delivered to the forward end of the machine as illustrated in FIG. 9. Lift table 70 is lowered to its lowermost position to facilitate the positioning of the stack on the upper end thereof. The lift table 70 is then raised to its proper position. The vaccum cups on the vacuum pick-up assemblies 126, 128, 130 and 132 move downwardly so that the vacuum cups 136 on the lower ends of the vertically movable plungers 134 engage the upper portion of the partition blank 10 as illustrated in FIG. 11. The lowering of the plungers 134 also causes the guides 150 to be pivotally moved outwardly as seen in FIG. 11. The vacuum at the vacuum cups 136 causes the uppermost blank 10 to adhere thereto. The pick-up assemblies are then vertically moved upwardly which causes the blank 10 to be moved from the position of FIG. 11 upwardly to the position of FIG. 12 with the guides 150 pivotally moving beneath the side edges of the blank 10 to support the same. The vacuum to the pick-up assemblies is then released so that the vacuum cups 136 disengage from the blank 10.

Conveyor 82 is then actuated so that the dogs 96 and 98 on the chains 84 and 86 engage the outer end 22 of the blank 10 to move the same inwardly into the machine. The blank 10 is moved inwardly into the machine until the score lines 34 and 36 are positioned directly beneath the L-shaped members 162 and 168. The operation of the conveyor 82 is momentarily halted by a suitable switch which senses the position of the blank 10. The tab breaker cylinders 160 and 166 are then actuated to cause the extension of the rods 158 and 164 therefrom so that the L-shaped members 162 and 168 separate the upper portion 28 of the blank 10 along the score lines 34 and 36 respectively as illustrated in FIG. 3. The tab breaker cylinders 160 and 166 are then retracted to raise the L-shaped members 162 and 168.

Conveyor 82 then moves the partition blank 10 further into the machine until the blank is positioned between the cell opening assemblies and the cell opening back-up assemblies. Cell opening assembly cylinder 184 is then actuated so that the vacuum cups 182 move upwardly into engagement with the underside of the flat partition blank. The vacuum cups 182 adhere to the underside or bottom portion of the partition blank and the retraction of the cell opening cylinder 184 causes the outer edges of the partition blank to be moved downwardly from the flat position to the position of FIG. 14 to initially create the cells. The cell opening back-up assemblies 186 and 188 are also actuated at this time to facilitate the creation of the cells. Preferably, the assemblies 186 and 188 are actuated momentarily after the assemblies 170, 172, 174 and 176. The extension of the rods 192 from the cylinders 190 causes the bars 196 to exert downward force on the blank as illustrated in FIG. 14 to aid in the folding of the partition blank. The partition blank folds along the score lines as illustrated in FIG. 4 as previously described. The vacuum is released from the cell opening assemblies and the belt conveyor 102 conveys the partially folded blank inwardly into the guide or side plow 198. The cell opening back-up cylinders 190 are then retracted to pivotally move the arms 194 upwardly and outwardly.

The partition blank is deformed from the position of FIG. 14 to the position of FIG. 16 as it passes through the side plow 198. The blank is then conveyed inwardly until the score lines 38 and 40 are directly below the tucker arms 202 and 204. At this time, the box elevator 124 will vertically move a box 14 upwardly towards the machine so that the guide 126 is adjacent the upper portion of the box 14. The tucker arms 202 and 204 are moved downwardly by the rotation of the shafts 206 and 208 and causes the blank to be folded from the position of FIG. 16 to the position of FIG. 6. In other words, the blank is folded upon itself along the score lines 38 and 40 in the manner depicted in FIG. 5. The tucker arms 202 and 204 not only fold the blank but also insert the blank downwardly between the belt portions 106 and 108 which convey the folded partition downwardly into the box 120. The box 14 is then lowered by the conveyor elevator 124 and moved to the conveyor 122. With the blank folded to the configuration of FIG. 6 and inserted into the box 14, six containers may be inserted into the box in the cells as previously described.

Thus it can be seen that a novel partition folding and inserting machine has been provided which automatically folds a flat partition blank to a folded position and inserts the same into a box so that the box will accommodate six containers. The partition folding and inserting machine of this invention not only reduces the amount of labor normally associated with such an operation, but permits the insertion of partitions into boxes or cases at a much higher rate than possible in manual operations.

Thus it can be seen that the invention accomplishes at least all of its stated objectives.

We claim:

1. An apparatus for folding and inserting a partition into a box, the partition being formed from a partition blank comprising a flat sheet member folded upon itself to define a blank member having a top blank portion and a bottom blank portion, opposite ends and opposite sides, said top blank portion having a first score line means formed therein spaced inwardly from one side thereof extending between its opposite ends, said top blank portion having a second score line means formed therein spaced inwardly from the other side thereof extending between its opposite ends, each of said first and second score line means being spaced inwardly from said sides approximately one-fourth the distance between said opposite sides, said top blank portion having a third score line means formed therein extending transversely to said first and second score line means and being positioned at the center of said top portion and extending outwardly therefrom towards said first and second score line means, said top blank portion being at least partially severed from said first and second score line means outwardly to said sides parallel to said third score and equidistantly between said opposite ends, said bottom blank portion having a first score line means formed therein spaced inwardly from said one side thereof, and extending between the ends thereof, said blank portion having a second score line means formed therein spaced inwardly from the outer side thereof and extending between the ends thereof, said first and second score line means in said bottom blank portion being spaced equidistantly inwardly from said sides, said first and second score line means of said bottom blank portion being spaced outwardly of said first and second score line means of said top blank portion, said bottom blank portion having a third and fourth score line means formed therein spaced equidistantly inwardly of said first and second score line means respectively, the distance between said third and fourth score line means in said bottom blank portion being approximately the same as the distance between said first score line means and said one side of said bottom blank portion, said bottom blank portion being secured between its said third and fourth score line means, to said top blank portion, said bottom blank portion being at least partially severed from said one side to said third score line means therein beneath said first score line means of said top blank portion, said bottom blank portion being at least partially severed from said other side to said fourth score line means therein beneath said second score line means of said top blank portion, said bottom blank portion being at least partially severed between the third and fourth score line means therein beneath the third score line means in said top blank portion, said blank member being scored along its opposite sides, said apparatus comprising a machine for folding said partition blank including a feed end and a discharge end comprising a partition blank support means at the feed end of said machine for supporting a plurality of said flat partition blanks stacked thereon, means for vertically moving said blank support means whereby the position of the uppermost blank may be selectively positioned, a vacuum pick-up means at the feed end of said machine positioned above said blank support means for picking up the uppermost blank from the stacked blanks, a conveyor means on said machine for feeding the blank into said machine, a tab breaking means on said machine for breaking said top blank portion along its said partially severed portions, a cell opening means on said machine for engagement with said blank member at the opposite sides thereof for folding the side edges thereof downwardly along said first and second score line means on said top blank portion and along said first and second score line means on said bottom blank portion, to create elongated first and second cells, a side plow means on said machine for forming said first and second cells into a rectangular configuration as said conveyor means moves the blank therethrough, a partition tucker assembly for folding said blank upon itself along said third and fourth score line means on said top blank portion and along said partially severed portions on said bottom blank portion whereby each of said first and second cells are separated to form a pair of cells, the cells at one side of said folded blank being spaced from the cells at the other side of said folded blank by a pair of cells, and means for inserting said folded blank into a box to define six container cells.

2. The combination of claim 1 wherein said vacuum pick-up means comprises a plurality of vertically movable vacuum cups which move downwardly into vacuum engagement with the said uppermost blank and which raise said blank into position at said conveyor means.

3. The combination of claim 1 wherein said tab breaking means comprises a pair of hydraulic cylinders positioned above said blank, each of said cylinders having a vertically movable cylinder rod having laterally extending blank engaging portions at their lower ends.

4. The combination of claim 1 wherein said cell opening means comprises a vertically movable vacuum pull-down means beneath said blank which move upwardly into engagement with the bottom blank portion and which cause the folding of said blank as said vacuum pull-down means is lowered.

5. The combination of claim 4 wherein said cell opening means also comprises a pair of hydraulic cylinders positioned above said blank, each of said hydraulic cylinders having a pivoted arm means connected thereto for urging the opposite sides of said blank downwardly upon said hydraulic cylinders being actuated.

6. The combination of claim 1 wherein said partition tucker assembly comprises a pair of rotatable tucker arms which engage said top blank portion along said third and fourth score line means.

7. The combination of claim 6 wherein said tucker arms also move the folded blank downwardly towards the discharge end of said machine.

8. An apparatus for folding and inserting a partition into a box, the partition comprising a single sheet folded upon itself to form top and bottom blank portions having rearward and forward ends and opposite side edges, a partition blank support means for supporting a plurality of flat partition blanks stacked thereon, means for vertically moving said blank support means whereby the position of the uppermost blank may be selectively positioned, a partition folding and inserting machine including a feed end and a discharge end, said blank support means being positioned adjacent the feed end of said machine, a vacuum pick-up means at the feed end of said machine positioned above said blank support means for picking up the uppermost blank from the stacked blanks, a conveyor means on said machine for feeding the blank into said machine, a tab breaking means on said machine for breaking said blank inwardly from its side edges towards the center portion thereof, intermediate the forward and rearward ends thereof, a cell opening means on said machine for engagement with the blank at the opposite sides thereof for folding the side edges thereof downwardly with respect to the center portion thereof to create elongated first and second cells, a side plow means on said machine for forming said first and second cells into a rectangular configuration as said conveyor means moves the blank therethrough, a partition tucker assembly for folding said blank upon itself whereby each of said first and second cells are separated to form a pair of cells, the cells at one side of said folded blank being spaced from the cells at the other side of said folded blank by a pair of cells, and means for inserting said folded blank into a box to define six container cells.

9. A partition folding and inserting machine including a feed end and a discharge end, comprising, a partition blank support means at said feed end for supplying flat partition blanks to the machine, a conveyor means for conveying an individual blank through said machine, blank folding means on said frame means for folding said blank from its flat position to a folded configuration which defines six partition cells with four of the cells being of the enclosed type with open upper and lower ends, and with two of the cells being of the three-sided type with open upper and lower ends, insertion means adjacent the discharge end of said machine for inserting the folded blank into a box so that the box will accommodate six containers.

10. An apparatus for folding and inserting a partition into a box having upstanding side walls and end walls, the partition comprising first and second partition members each comprising a vertically disposed first wall portion having opposite ends, upper and lower ends, and opposite side wall surfaces; a second vertically disposed wall portion extending transversely from one end of said first wall portion and having an outer end; a third wall portion extending transversely from the outer end of said second wall portion and having an inner end; a fourth wall portion extending transversely from the inner end of said third wall portion to said first wall portion; a fifth wall portion extending from said fourth wall portion adjacent the center portion of said first wall portion and being secured thereto; a sixth wall portion extending transversely from said fifth wall portion and having an outer end; a seventh wall portion extending transversely from the outer end of said sixth wall portion and having an outer end; an eighth wall portion extending transversely from the outer end of said seventh wall portion to the other end of said first wall portion; said first, second, third and fourth wall portions defining a first cell; said fourth, fifth and sixth wall portions defining a second cell; said sixth, seventh and eighth wall portions defining a third cell, the first wall portions of said first and second partition members being positioned adjacent each other, the lower ends of the first wall portions of said first and second partition members being connected, comprising, means for folding said partition into its final configuration, and means for inserting the partition into the box to define six cells.

* * * * *